US006644208B2

(12) United States Patent
Akiyama

(10) Patent No.: US 6,644,208 B2
(45) Date of Patent: Nov. 11, 2003

(54) TRACK GUIDED VEHICLE SYSTEM

(75) Inventor: Takuo Akiyama, Kounan (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/126,574

(22) Filed: Apr. 22, 2002

(65) Prior Publication Data

US 2002/0157562 A1 Oct. 31, 2002

(30) Foreign Application Priority Data

Apr. 27, 2001 (JP) ..... 2001-131904

(51) Int. Cl.[7] ..... E01B 25/06

(52) U.S. Cl. ..... 104/130.1; 104/130.04; 104/140

(58) Field of Search ..... 104/130.1, 130.04, 104/130.07, 138.1, 139, 290, 140, 104, 105; 105/156, 154

(56) References Cited

U.S. PATENT DOCUMENTS 3,628,462 A * 12/1971 Holt ..... 104/105
3,702,590 A * 11/1972 Corey ..... 104/105
3,712,238 A * 1/1973 Colovas et al. ..... 104/130.07
3,830,163 A * 8/1974 Wright et al. ..... 104/105
4,000,700 A * 1/1977 Hannover et al. ..... 104/130.07
4,671,185 A * 6/1987 Anderson et al. ..... 104/130
4,893,566 A * 1/1990 Fukuda ..... 104/140
5,454,328 A * 10/1995 Matsuzaki et al. ..... 104/139

FOREIGN PATENT DOCUMENTS

JP 6-29141 8/1994

* cited by examiner

*Primary Examiner*—S. Joseph Morano
*Assistant Examiner*—Frantz F. Jules
(74) *Attorney, Agent, or Firm*—Armstrong, Westerman & Hattori, LLP.

(57) ABSTRACT

A driving wheel is displaced downward by running off a traveling wheel when a vehicle passes through a diverging part and a detection value of an encoder provided in the driving wheel becomes incorrect by spinning free of the driving wheel. A track is equipped with a pair of the right and left traveling rails for traveling of a traveling wheel equipped with a vehicle, a slit formed to pass a traveling vehicle body between the traveling rails and a traveling face provided over the traveling rails, and the vehicle is provided with a pressure device for contacting a drive wheel with a traveling face.

4 Claims, 10 Drawing Sheets

TRACK GUIDED VEHICLE SYSTEM

FIELD OF THE INVENTION

The present invention relates to a track guided vehicle system equipped with a track guided vehicle having a traveling wheel and a traveling rail having a diverging part, more paticularly to the traveling performance improvement of the track guided vehicle in the diverging part.

BACKGROUND OF THE INVENTION

The track guided vehicle system which makes a vehicle provided with the traveling wheel travel on a track having the diverging part is existed from the past. The following overhead vehicle is known as an example of such a track guided vehicle.

The track is laid on a ceiling such that the cross section is formed inverted U-shape and an opening part is located down below, and the traveling wheel of the vehicle is arranged to travel on the traveling rail which is exited from the lower end of the opening side to the inside of the track in an extended condition. Each pair of the traveling wheels is provided back and forth and at lease one of a total of four traveling wheels is acted as a driving wheel. An interval is formed between the right and left traveling rails served as a pair, and a slit is formed along a laying direction of the track.

Meanwhile, the vehicle is composed of a traveling vehicle body in the upper part and an article support part in the lower part, and the traveling vehicle body is located in the track and the article support part is located below the track.

The traveling wheel is provided in the traveling vehicle body and the article support part is arranged to retain articles. Moreover, the width only for the vehicle to pass is provided in the slit and the vehicle can travel along the track.

A pair of diverging rollers is provided in the upper part of the vehicle, and a guide groove which can contact with the diverging roller is formed in the track. The vehicle is arranged to guide to one side of the diverging route by contacting with one diverging roller in the diverging part.

A traveling wheel provided in a traveling vehicle body crosses a slit when the vehicle is passed through a diverging part. A driving wheel is run off from a traveling rail then and the vehicle becomes the state of falling into the slit temporarily.

If a rotating sensor equipped with an encoder is provided in a drive shaft of the driving wheel for controlling the position of the vehicle, the detection value of the encoder becomes incorrect by spinning free of the driving wheel. Thus, the detection value of the encoder is changed every time passing the diverging part and the position of the vehicle cannot be controlled correctly.

SUMMARY OF THE INVENTION

The object to be solved by the present invention is described above, and next, the means for solving the object will be described.

More precisely, the vehicle is traveled on a track served as a groove or a slit between traveling rails in a track guided vehicle system having right and left traveling rails and a diverging part on the way, wherein the vehicle is traveled on the traveling rail such that a part of the traveling wheel supporting the vehicle blocks the groove or the slit in the diverging part and the vehicle is driven to travel by pressing the top or bottom driving wheel energized to either one side to the traveling face formed along the track.

The track including the traveling rail and the traveling face is shaped like a long tube as one.

The vehicle has a diverging roller likewise, and the traveling direction of the vehicle is arranged to switch in the diverging part by that the diverging roller is contacted with a plurality of guide grooves formed along the track selectively.

DETAILED DESCRIPTION OF THE PREFERRED EMBODIMENT

Hereinafter, a preferred embodiment of the present invention will be described with reference to the drawings. First, a track guided vehicle system utilizing the way of supplying power in a non-contact manner will be described.

Figure 1:
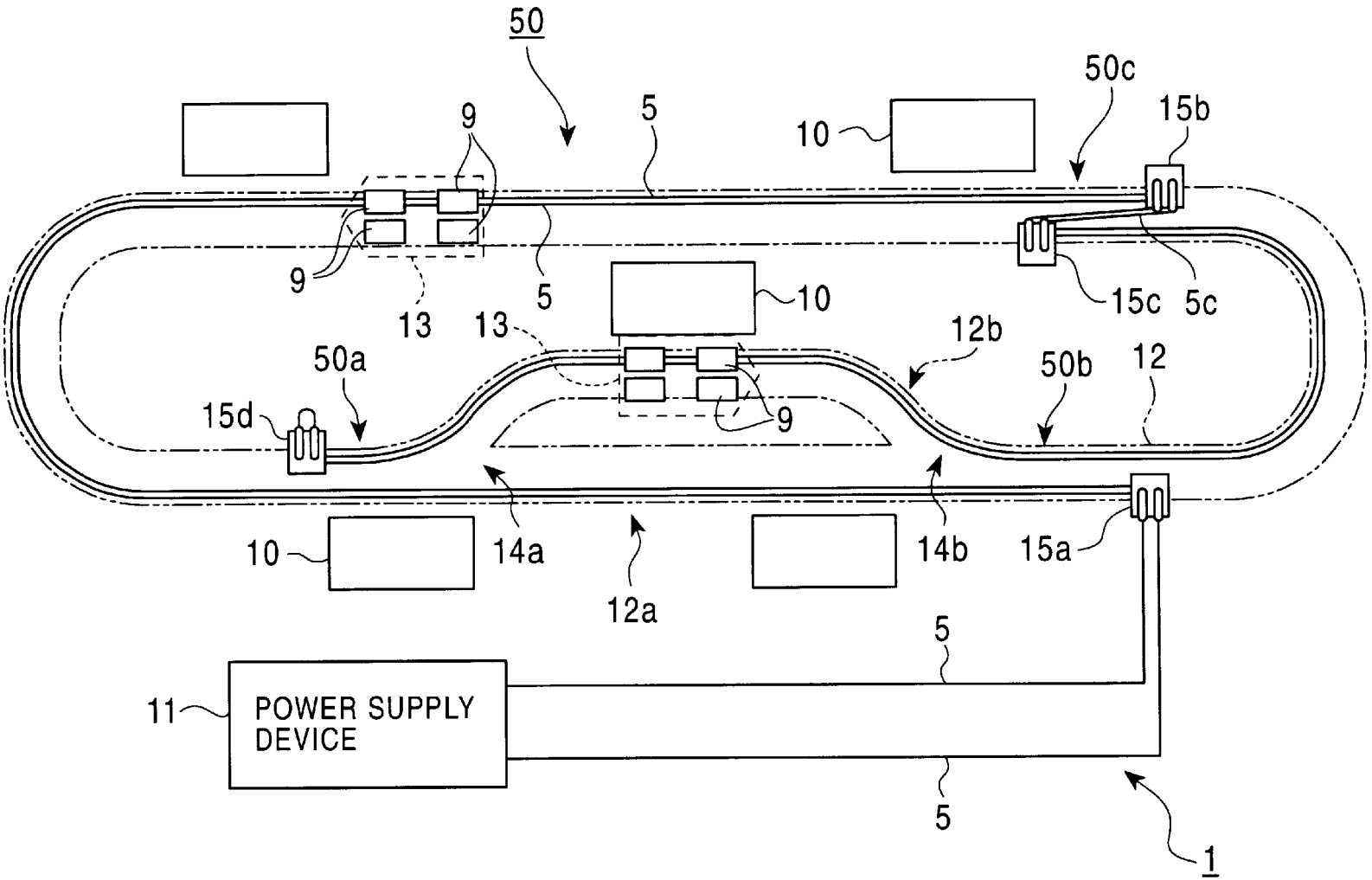
FIG. 1 is a view showing a frame format of a track guided vehicle system.

In FIG. 1, a track 12 is laid on a moving route of a track guided vehicle (hereinafter called "vehicle") 13 and power feeders 5, 5 made by covering a conductive wire such as a copper wire with an insulating material is disposed along the track 12. A plurality of stations 10, 10 is disposed in the track 12 side part, and articles can be carried from one station 10 to the other station 10 by moving the vehicle 13 between the stations 10, 10.

A power supply device 11 is provided in one end of the power feeders 5, 5, and power is supplied to the power feeders 5, 5 in a predetermined frequency (high frequency). The vehicle 13 is arranged to travel by driving a motor 16 (mentioned later) by high frequency current supplied from the power supply device 11.

The vehicle 13 has a pick up unit 9 for acquiring power from the power feeders 5, 5, and at least one pair of the right and left pick up units 9, 9 is disposed in the vehicle 13. The weight balance of the whole vehicle body is maintained by disposing the pick up units 9, 9 respectively in the vicinity of the vehicle body as the weight ratio of this pick up unit 9 is high in the vehicle body, so that the vehicle 13 can travel a curved part smoothly, for example. Two pairs of the pick up unit 9 are disposed in the vicinity of the vehicle body in the preferred embodiment of the present invention, however a pair of bigger pick up units can be disposed in the right and left of the center of the vehicle body. The vehicle 13 is moved on the track 12 by utilizing the power picked up by the pick up unit 9.

The track 12 is composed of a main track 12*a* that is a loop track and a bypass route 12*b* formed in the main track 12*a*. Here a connecting part of the main track 12*a* and the bypass route 12*b* are served as diverging parts 14*a*, 14*b*.

The power feeders 5, 5 are constructed on the main track 12*a* and the bypass route 12*b* and a pair of power feeders 5, 5 is acted as outward and homeward routes and a power feeding route 50 is formed as a whole. As the vehicle 13 can receive power wherever on the track 12, a pair of power feeders 5, 5 is disposed in at least one of the right and left sides of the track 12.

In other words, at least one pair of the power feeders 5, 5 is constructed in the side part of the track 12.

Moreover, a pair of the power feeders 5, 5 is disposed respectively on the both sides in a part of the track 12, and a total of two pairs of power feeders 5, 5 is disposed. The parts that the power feeders 5, 5 are disposed on the both sides of the track 12 are overlapping parts 50*a*, 50*b* located in an entrance door side of the bypass route 12*b* and an overlapping part 50*c* which moves the power feeders 5, 5 laid in the outer (or inner) side part of the track 12 to the inner (or outer) side part of the track 12.

The power feeders 5, 5 are connected via terminals 15*a*, 15*b*, 15*c* etc. A terminal 15*d* is connected such that end parts of the inward and homeward routes of the power feeders 5, 5 are short-circuited and the dead end part of the power feeding route 50 is formed. Additionally, the beginning end part of the power feeding route 50 is the power supply device 11.

The vehicle 13 can be the overhead or floor vehicle if it is the track guided vehicle. Hereinafter, the preferred embodiment of the present invention that the overhead vehicle is used as the vehicle 13 will be described with reference to FIG. 2 to FIG. 10, if not explained especially.

Figure 2:
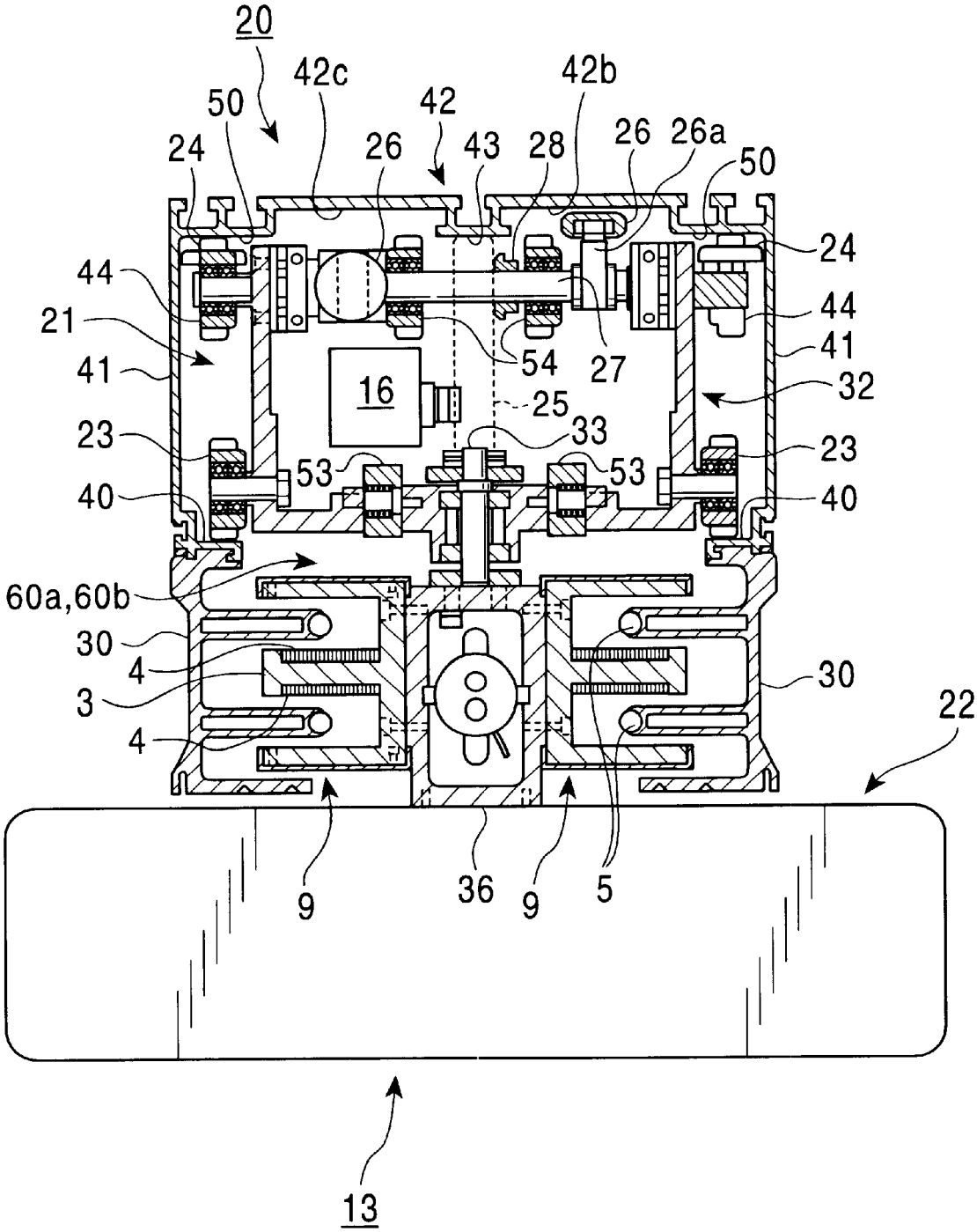
FIG. 2 is a front sectional view of a vehicle.
Figure 3:
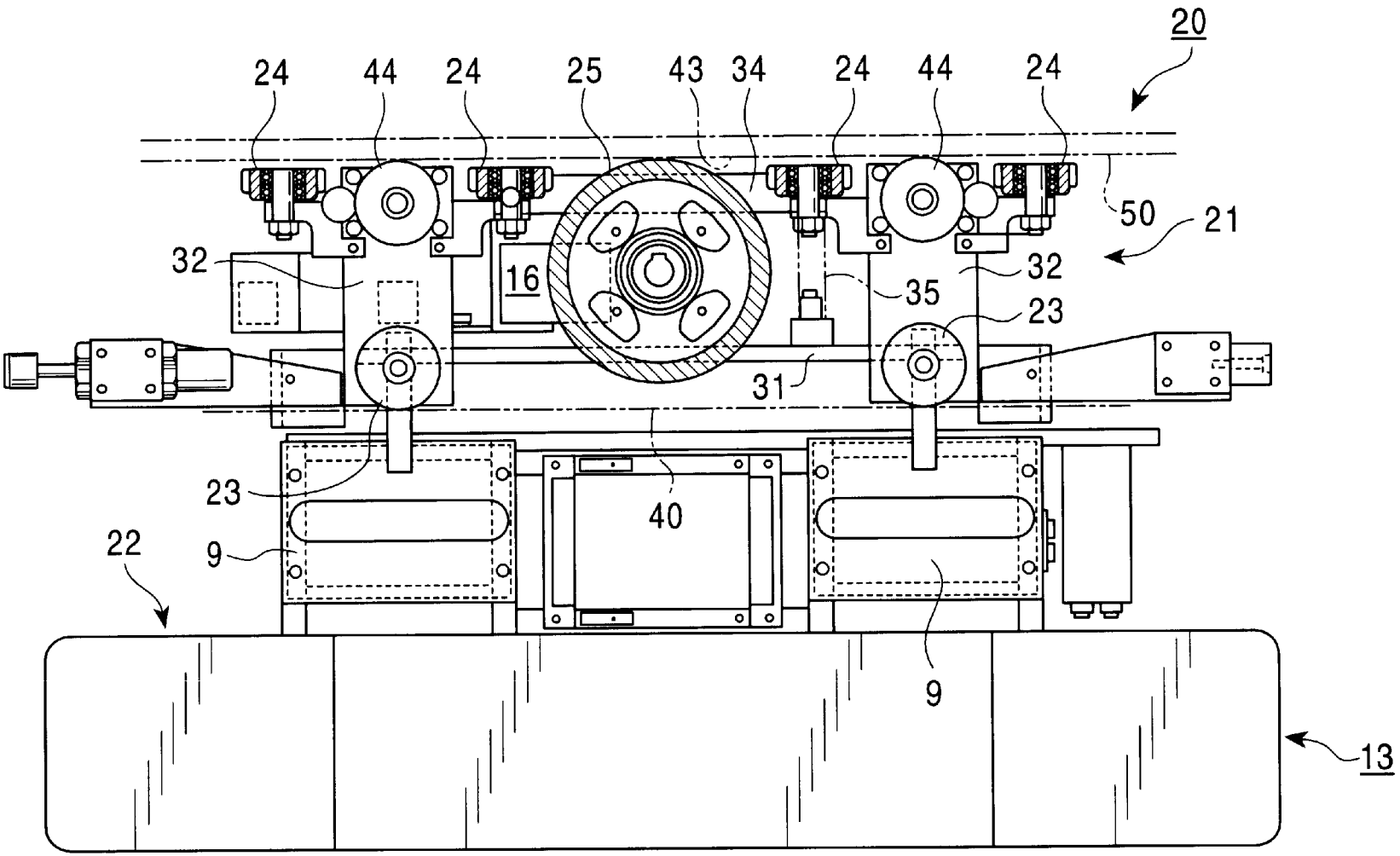
FIG. 3 is a side sectional view of the vehicle.

In FIG. 2 and FIG. 3, a track 20 is formed like inverted U-shape seen from the cross section and fixed on the ceiling. The track 12 is composed of the track 120 in the diverging part and the track 20 in the non-diverging part. The track 20 is formed like a line or a curve.

Figure 4:
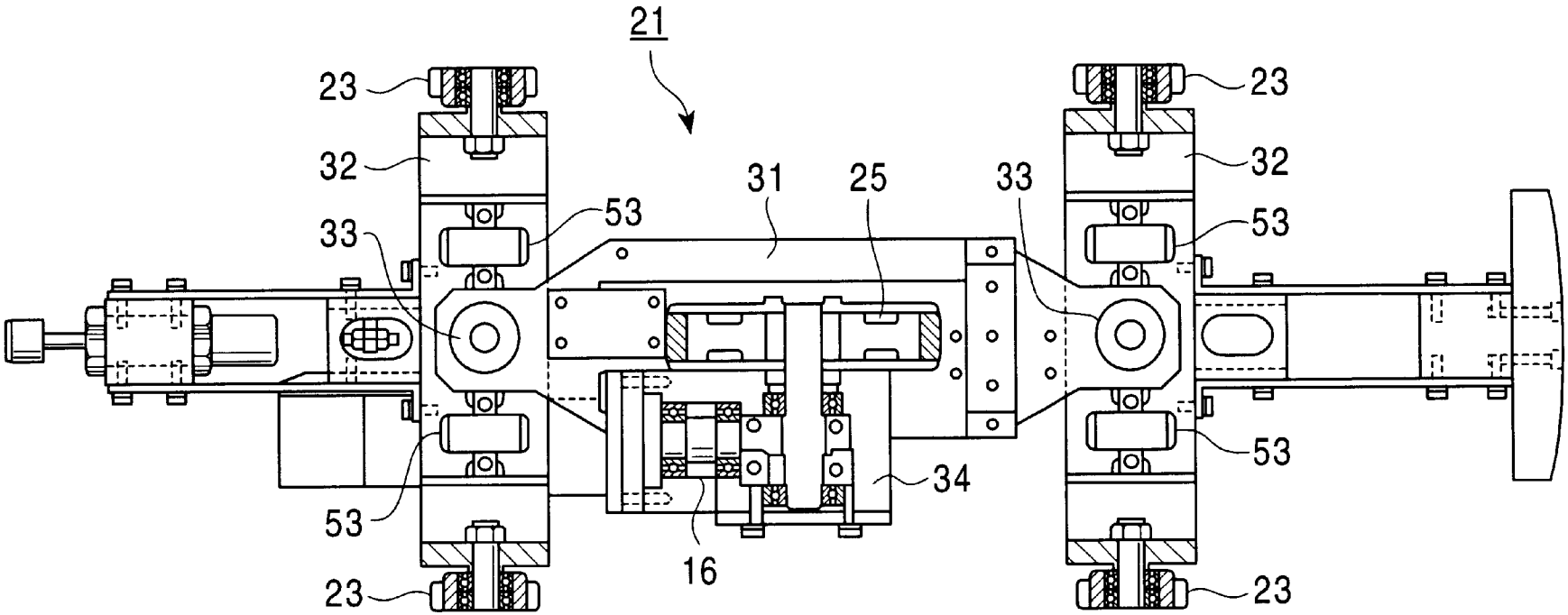
FIG. 4 is a top sectional view of the vehicle illustrating a design configuration of a traveling wheel and a training wheel.

The vehicle 13 traveling on the track 20 is provided with a traveling vehicle body 21 in the upper part and an article support part 22 in the lower part. The traveling vehicle body 21 comprises a central main frame 31 and wheel support parts 32, 32 located in the vicinity of the main frame 31. As illustrated in FIG. 4, the wheel support parts 32, 32 and the main frame 31 are connected through rotating fulcrum shafts 33, 33, and the wheel support parts 32, 32 can rotate freely to the main frame 31.

Moreover, the article support part 22 arranged to load articles is provided below the traveling vehicle body 21. The traveling vehicle body 21 and the article support part 22 are connected by a connecting body 36, and the article support part 22 is supported by the traveling vehicle body 21. Further, the pick up units 9, 9 . . . are installed back and forth and right and left fixedly in the right and left of the connecting body 36.

As illustrate in FIG. 2 to FIG. 4, traveling wheels 23, 23 having an axel to right and left directions are disposed on the both right and left sides in the lower part of the wheel support part 32, and the axel is installed in the wheel support part 32 fixedly. Moreover, the traveling wheels 23, 23 . . . are arranged to be disposed in the vicinity of the vehicle 13 as the wheel support parts 32, 32 are located in the vicinity of the main frame 31. Due to the above configuration, the traveling wheels 23, 23 . . . are disposed in at least back and forth and right and left of the vehicle 13.

The protruding part to the inner side from right and left is provided in the lower part of the track 20 and used as a pair of traveling rails 40, 40. The upper face of the traveling rail 40 is formed horizontal and the vehicle 13 is arranged to travel on the traveling rails 40, 40 by contacting the traveling wheels 23, 23 on the traveling rail 40.

Moreover, an interval enough to pass the traveling vehicle body 21 is provided in between the traveling rails 40, 40. The interval is provided along the track 12 and slits 60*a*, 60*b* are formed in the track 20. In addition, the slit 60*a* is formed on the main track 12*a* and the slit 60*b* is formed on the bypass route 12*b*.

Figure 5:
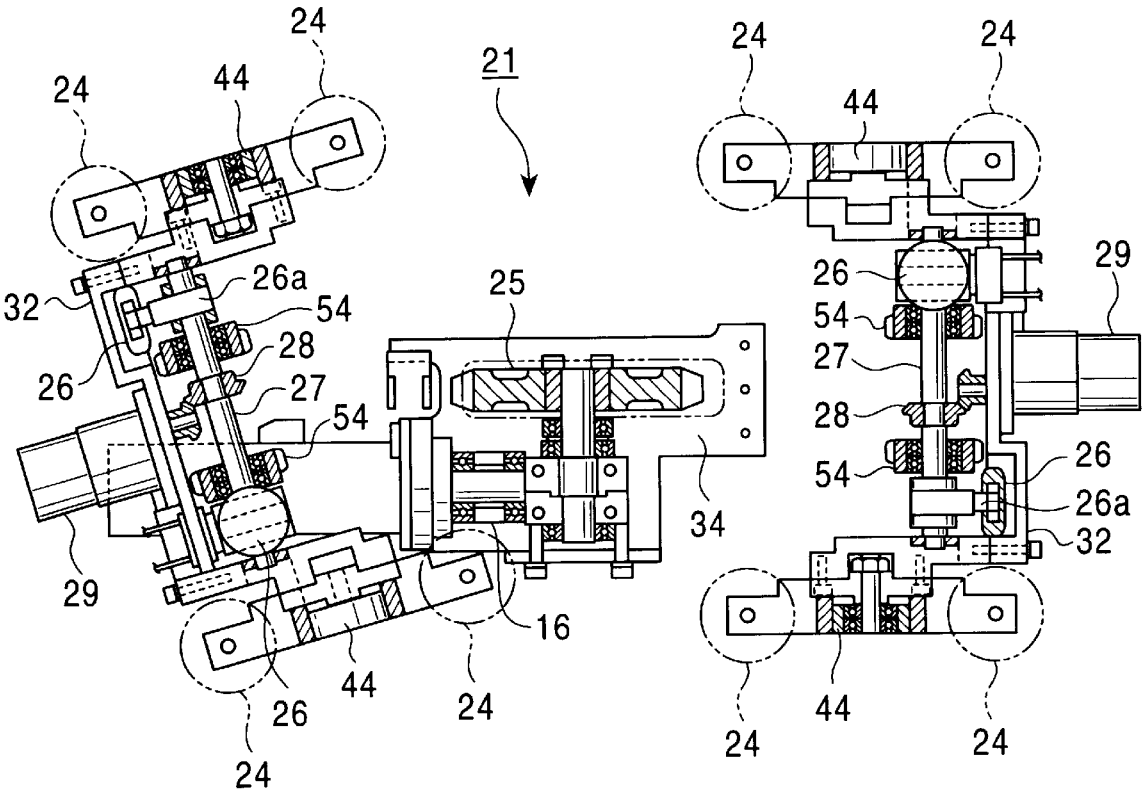
FIG. 5 is a top sectional view of the vehicle illustrating the design configuration of a diverging roller.

As illustrated in FIG. 2, FIG. 3 and FIG. 5, guide wheels 24, 24 . . . having an axel to vertical direction are disposed on the both right and left sides in the upper part of the wheel support part 32, and the axel is installed in the wheel support part 32 fixedly. Two guide wheels 24, 24 . . . are provided back and forth respectively in the both right and left of the wheel support part 32, and the guide wheels 24, 24 . . . are arranged to be disposed in at least back and forth and right and left of the vehicle 13 same as the traveling wheels 23, 23 . . .

Side parts 41, 41 are formed in the both right and left sides of the track 20 by turning to the lateral side (the upper side) than the outer end part of the traveling rails 40, 40, and the displacement of the vehicle 13 to right and left directions can be prevented by using the side part 41 as the guide face of the guide wheels 24, 24 . . .

An upper part 42 connects the upper ends of the side parts 41, 41 in the track 20. As described above, the track 20 including the traveling rails 40, 40 and a traveling face 43 as mentioned later is shaped like a long tube.

The track 20 is shaped as one due to the structure as mentioned above, so that the track 20 can be manufactured by the drawing process utilizing such as an aluminum and the number of parts can be reduced and the fixing becomes easier.

The motor 16 is disposed in the central part of the back and forth direction of the traveling vehicle body 21. The motor 16 is installed in a support body 34 fixedly over the motor 16. The support body 34 is supported such that one end swings freely up and down to the main frame 31 of the traveling vehicle body 21 and the other end is installed in a pressure means 35. The pressure means 35 is served as a spring in the preferred embodiment of the present invention and disposed as a compressed spring. So, the support body 34 is always energized upward and a drive wheel 25 provided in the support body 34 is arranged to press to the traveling face 43 as mentioned later.

The drive wheel 25 having the drive shaft to right and left directions is provided rotatably in the support body 34, and the drive wheel 25 is arranged to be driven by the motor 16. Moreover, the traveling face 43 whose lower face is formed horizontally is provided in the central part of the upper part 42. The drive wheel 25 is provided in the center of the right and left in the traveling vehicle body 21 so as to contact with the traveling face 43, and the drive wheel 25 is always contacted with the traveling face 43 with the upward energization power by the pressure means 35. Consequently, the vertical position of the drive wheel 25 is arranged not to change by contacting the drive wheel 25 with the traveling face 43 when running off as mentioned later, that is to say that such as the traveling wheel 23 is run off from the traveling rail 40 temporarily.

Additionally, grooves 42*b*, 42*c* which make diverging rollers 26, 26 pass are formed on the both right and left sides of the downward traveling face 43 in the upper part 42 of the track 20.

When the traveling face 43 is formed in the central part of the upper part 42 and the drive wheel 25 is provided in the center of the right and left of the traveling vehicle body 21 so as to contact with the traveling face 43, the driving wheel can be one wheel.

Moreover, the vehicle 13 is traveled along a curve by the guide wheels 24, 24 in the curve part of the track 12 and traveled curved by guiding with the diverging roller 26 in the diverging parts 14*a*, 14*b*, so that the traveling vehicle body 21 does not need a steering mechanism so as to control the turning angle with the computer in line with the curvature of the curve part and the structure of the vehicle 13 can be easier.

Moreover, the positional control of the vehicle 13 can be implemented by providing a rotating sensor in the drive shaft of the drive wheel 25. For example, the position of the vehicle 13 can be determined based on the inspecting result of the rotating sensor. Further, the vehicle 13 is driven until an input value is equal to the detection value by inputting the necessary rotation number (of the drive wheel 25) from the present position to the destination to the control device of the vehicle 13, and the vehicle 13 can be controlled to reach the destination.

The rotating sensor picks up the rotation number of the drive shaft by converting to the pulse signal and measures the rotation number by converting pulse with the encoder equipped with the rotating sensor. Consequently, the drive wheel 25 spins free and only the rotation number is counted though the vehicle 13 does not travel on the track 12 if the drive wheel 25 is apart from the traveling face 43, so that the positional control of the vehicle 13 becomes incorrect.

As described above, the drive wheel 25 is prevented from spinning free by always contacting the drive wheel 25 with the traveling face 43 by the pressure means 35. Therefore, the positional control of the vehicle 13 can be implemented correctly in the track guided vehicle system 1 of the present invention.

Figure 6:
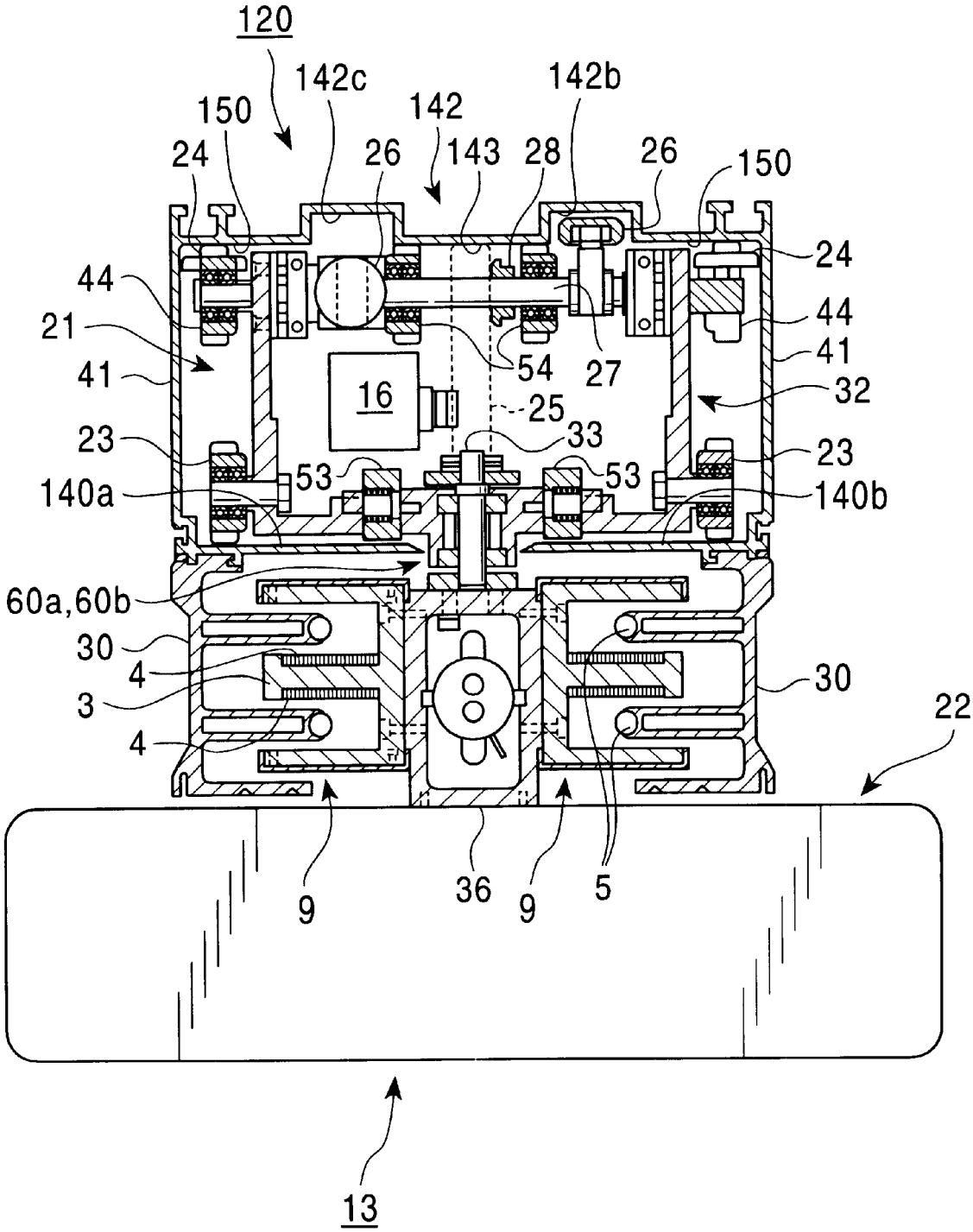
FIG. 6 is a front sectional view illustrating a track in a diverging part.

The diverging rollers 26, 26 are provided in the back and front wheel support parts 32, 32 for traveling on either the bypass route 12*b* or the main track 12*a* in the diverging parts 14*a*, 14*b*. In other words, as illustrated in FIG. 2, FIG. 5 and FIG. 6, support shafts 26*a*, 26*a* are protruded to a switching shaft 27 at right angles by displacing at 90 degrees on the both right and left sides on the switching shaft 27 laid horizontally to right and left directions and the diverging rollers 26, 26 are disposed rotatably to support shafts 26*a*, 26*a*. A bevel gear 28 is installed fixedly on the switching shaft 27 by linking with and moving in response to the switching motor 29 and the switching motor 29 is rotated normally and reversely, so that one of the diverging rollers 26, 26 is arranged to turn upward by turning the switching shaft 27.

Meanwhile, a track 120, in which the shapes of the upper part 42 and the traveling rails 40, 40 are different than the shapes in the track 20, is provided in the diverging part 14*a*, 14*b*. The track 20 is a rail used in the non-diverging part. Hereinafter, the same name and code are used in the same part in the track 20 and the track 120 and the explanation is omitted. Moreover, FIG. 7 to FIG. 10 illustrate the diverging part 14*a*, however the diverging part 14*b* also has the same structure.

Figure 7:
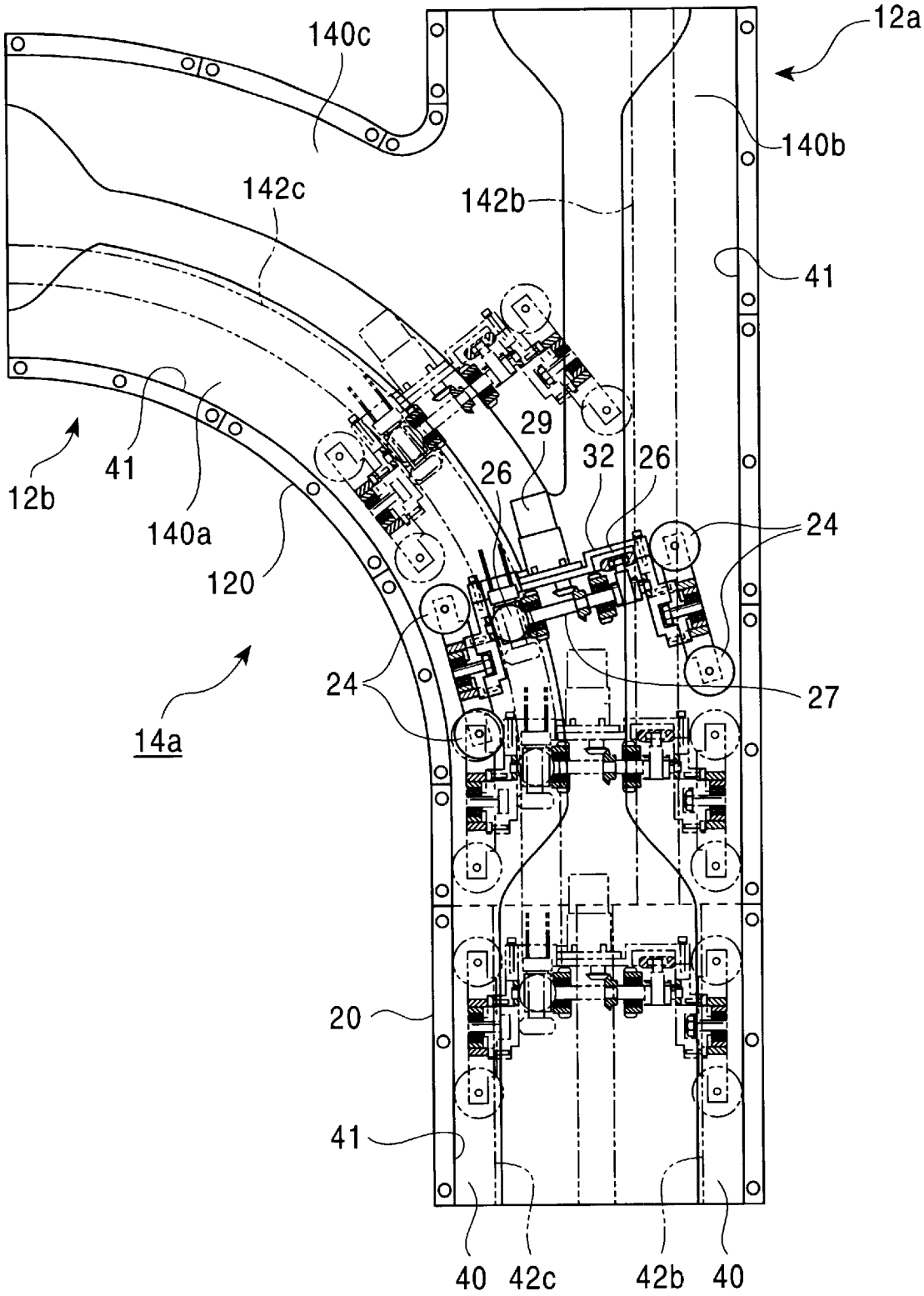
FIG. 7 is a plan view illustrating the upper part of the track in the diverging part.

As illustrated in FIG. 6 and FIG. 7, guide grooves 142*b*, 142*c* so as to contact with the diverging rollers 26, 26 are provided in an upper part 142 of the track 120. Moreover, in the diverging part a traveling face 143 whose width is broader than the one of the traveling face 43 in the non-diverging part is formed in the center of the upper part 142. The guide grooves 142*b*, 142*c* are located in the right and left of the traveling face 143 and opens downward by forming concave, and the diverging roller 26 is arranged to guide by the both right and left walls in an opening part of the guide grooves 142*b*, 142*c*.

One guide groove 142*b* is provided along the main track 12*a* and the other guide groove 142*c* is provided along the bypass route 12*b*.

When the vehicle 13 enters the diverging part 14*a* (14*b*) in case of the structure, the diverging roller 26 protruded upward enters the guide groove 142*b* or the guide groove 142*c* by driving a switching motor 29 and turning either right or left diverging roller 26 upward and the other diverging roller 26 is traveled along the guide groove entered the diverging roller 26 by nudging out of the guide groove 142*b* (or the guide groove 142*c*) in the state of evacuating forward or backward and the vehicle 13 can travel by choosing either the main track 12*a* or the bypass route 12*b*.

In other words, as the vehicle 13 is disposed to contact with one guide groove 142*b* (or the guide groove 142*c*) and equipped with a switching mechanism disposed such that the diverging roller 26 is not contacted with the other guide groove 142*c* (or the guide groove 142*b*), the vehicle 13 is arranged to travel by choosing either a circulating track or the bypass route 12*b* by operating the switching mechanism and changing the diverging roller 26 between the contact and non-contact positions.

Moreover, the guide grooves 142*b*, 142*c* can support the diverging rollers 26, 26 to some extent in the inner side wall of the guide grooves 142*b*, 143*c* as being formed in the upper part of the vehicle 13. As mentioned later, the traveling wheel 23 sometimes runs off in the diverging parts 14*a*, 14*b*. The measurement so as to provide the training wheel as mentioned later is implemented for preventing the vehicle 13 from leaning by running off in the preferred embodiment of the present invention, however the guide grooves 142*b*, 142*c* can support the vehicle 13 effectively through the diverging rollers 26, 26 and the vehicle 13 can be traveled stablely.

As described above, the guide grooves 142*b*, 142*c* contacted with the diverging roller 26 are equipped with the one pair of the right and left traveling rails 40, 40 (such as the traveling rails 140*a*, 140*b*), the slits 60*a*, 60*b* formed to pass the traveling vehicle body 21 between the traveling rails 40, 40, the traveling face 43 provided above the traveling rails 40, 40 and the track 120 of the diverging parts 14*a*, 14*b*, and the above structure of providing the pressure means 35 for contacting the drive wheel 25 with the traveling faces 43, 143 can be applied to the floor vehicle as well as the vehicle 13.

Figure 8:
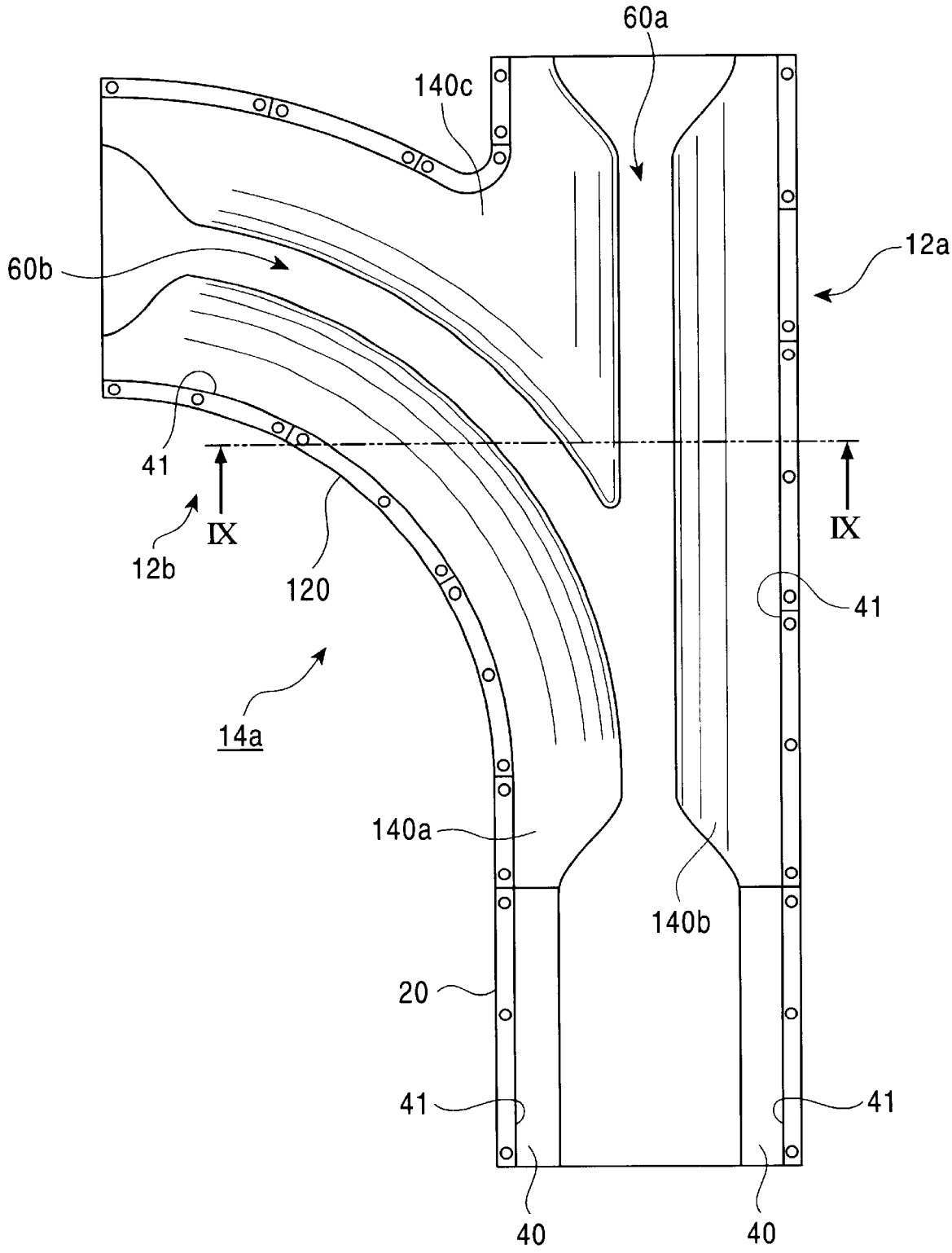
FIG. 8 is a plan view of the track illustrating traveling rails.

As illustrated in FIG. 6 and FIG. 8, the traveling rails 140*a*, 140*b*, 140*c* are provided in the track 120 in the diverging part 14*a* (14*b*). The traveling rails 140*a*, 140*b* are disposed in the right and left of the track 120 in the entrance on the contra-bypass route 12*b* side of the diverging part 14*a* (14*b*) (the lower part in FIG. 8). The right and left means the right and left to the traveling direction of the vehicle 13. Moreover, there are two outlets in the diverging part 14*a* (14*b*) on the main track 12*a* side and the bypass route 12*b* side, however the traveling rails 140*a*, 140*c* are disposed in the right and left of the track 120 on the bypass route 12*b* side and the traveling rails 140*c*, 140*b* are disposed in the right and left of the track 120 on the main track 12*a* side.

Figure 10:
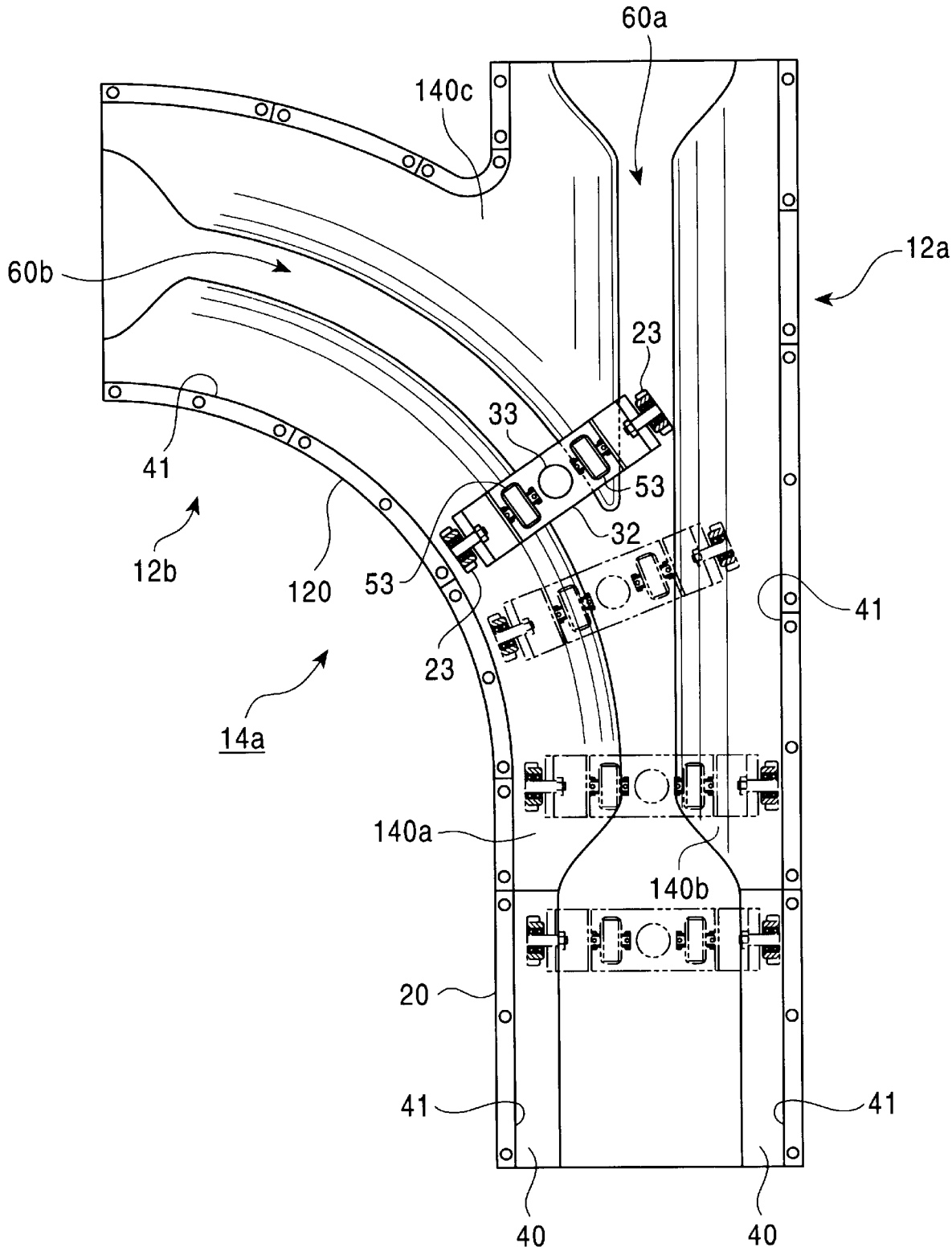
FIG. 10 is a plan view of the track illustrating an appearance that a lower part of a wheel support part crosses a slit in the diverging part.

As illustrated in FIG. 8 and FIG. 10, even if the vehicle 13 chooses either the main track 12*a* or the bypass route 12*b* in the vicinity of passing the diverging part 14*a* (14*b*), the traveling wheel 23 and a training wheel 53 as mentioned later crosses either the slit 60*a* or the slit 60*b*. For example, when the vehicle 13 chooses the bypass route 12*b* in the diverging part 14*a*, the traveling wheel 23 is run off from the traveling rail 140*b* first, crosses the slit 60*a* and runs on the traveling rail 140*c*. This is also applied to the training wheel 53.

Figure 9:
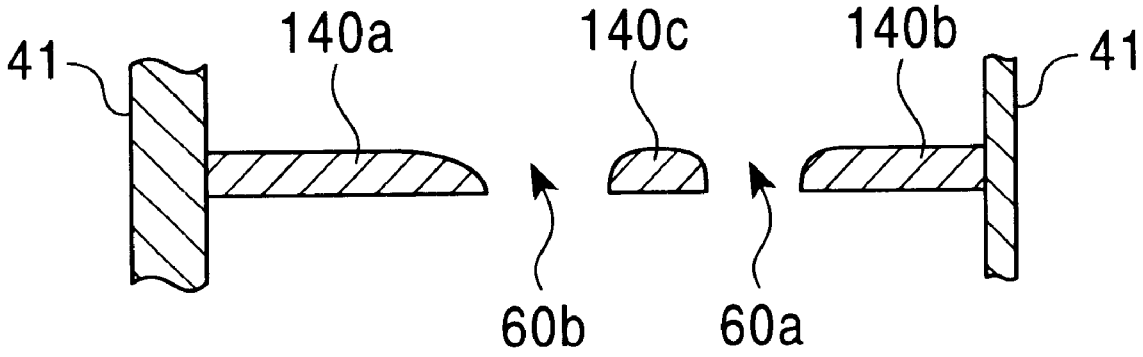
FIG. 9 is a sectional view taken substantially along a line IX—IX of FIG. 8.

Meanwhile, as illustrated in FIG. 9, the corner on the slits 60*a*, 60*b* side of the traveling rails 140*a*, 140*b*, 140*c* is formed smoothly in the diverging part 14*a* (14*b*). Namely, the end face is arranged to be curved. Thus, the traveling wheel 23 and the training wheel 53 crosses the slits 60*a*, 60*b* and the shock generated in running on the traveling rail 140*c* (or the traveling rails 140*a*, 140*b*) is arranged to be resisted. Consequently, the vehicle 13 can carry articles smoothly by preventing from generating the displacement by the shock of running off when the vehicle 13 is run on the traveling rail. Moreover, percussive noises when running on can be reduced.

Additionally, all the corners on the slit side of the traveling rail are not always formed smoothly. The above effect can be acquired if the corner of the traveling rail is formed smoothly in the vicinity that at least the traveling wheel 23 and the training wheel 53 crosses the slits 60*a*, 60*b*.

Moreover, the vehicle 13 can be used as the floor vehicle (the vehicle whose article support part is over the traveling vehicle body). The vehicle 13 and the track 20 are turned upside down from the state as illustrated in FIG. 2, FIG. 3 and FIG. 6 and the article support part 22 is arranged to be located on the upper side. The track 20 is arranged to be installed in the floor face fixedly or hanged from the ceiling by using the support member.

A traveling wheel 44 having the axel to right and left directions is provided on the outer side of the upper part of the wheel support part 32. As illustrated in FIG. 5, the traveling wheel 44 is disposed between the guide wheels 24, 24.

The traveling rails 50, 50 are formed in the both right and left end parts of the upper part 42 of the track 20 of the non-diverging part. If the vehicle 13 is turned upside down to be the floor vehicle, the vehicle 13 is supported by the traveling wheels 44, 44 and can be traveled by contacting the traveling wheels 44, 44 with the traveling rails 50, 50. Traveling rails 150, 150 are formed in the upper part of the track 120 of the diverging part as well.

The guide grooves 142*b*, 142*c* are formed as the grooves in the upper part 142 of the track 120, and the grooves 42*b*, 42*c* are formed in the both sides parts of the traveling face 43 in the upper part 20 of the track 20. The opening parts of the grooves 42*b*, 42*c* are formed broader than the ones of the guide grooves 142*b*, 142*c*. More precisely, the grooves 42*b*, 42*c* are formed to the extent that the width of the traveling rails 50, 50 is a little broader than the width of the traveling wheels 44, 44 and the width of the traveling face 43 is a little broader than the width of the drive wheel 25, and the guide grooves 142*b*, 142*c* are formed to the extent of being more or less broader than the width of the diverging roller 26.

When the vehicle 13 served as the floor vehicle enters in the diverging part, the traveling wheel 44 located on the opposite side of the diverging route chosen by the vehicle 13 is run off to the groove formed in the guide groove. For example, the traveling wheel 44 on the left side is run off if the vehicle 13 chooses the diverging route on the right side. As described above, this is the same structure as the case that the traveling wheel 23 is run off in the slit.

If the vehicle 13 is served as the floor vehicle in order to resist the shock which is generated in running off the traveling wheel 44, the corner of the guide grooves 142*b*, 142*c* that is the groove and the corner of the grooves 42*b*, 42*c* are formed smoothly, and the displacement by the shock of running on is prevented from generating.

Additionally, training wheels 54, 54 in case that the vehicle 13 is served as the floor vehicle are installed in the rotating shaft 27 of the diverging rollers 26, 26. Either the traveling wheel 44 or the training wheel 54 is arranged to be run off to the guide grooves 142*b*, 142*c* of the diverging part 14*a* (14*b*) by these training wheels 54, 54, so that the vehicle 13 is not leaned up and down by running off.

Moreover, as the traveling rails 50, 50 are shaped to the extent of being a little broader than the width of the traveling wheel 44, the vehicle 13 is supported only by the traveling wheels 44, 44 in the track 20 that is a straight part and can travel stably.

The weight of the vehicle 13 is put on the end part on the slits 60*a*, 60*b* side of the traveling rails 140*a*, 140*b*, 140*c* when the traveling wheel 23 (the training wheel 53) is run off or run on in the diverging part 14*a* (14*b*). Then, the deflection can be generated in the traveling rails 140*a*, 140*b*, 140*c*.

In the preferred embodiment of the present invention, the strength of the traveling rails 140*a*, 140*b*, 140*c* in the diverging part 14*a* (14*b*) is higher than the traveling rails 40, 40 in the non-diverging part. Due to the structure as mentioned above, the deflection is prevented from generating in the traveling rails 140*a*, 140*b*, 140*c* in passing the vehicle 13 through the diverging part 14*a* (14*b*). The positions of the right and left traveling rails 140*a*, 140*b* etc. across the slots 60*a*, 60*b* are prevented from changing, and the vehicle 13 is arranged to travel on the diverging part 14*a* (14*b*) smoothly.

The training wheels 53, 53 having the axel to right and left directions is provided rotatably to the wheel support part 32 in the inside of the traveling wheels 23, 23 provided in the wheel support part 32.

Meanwhile, as illustrated in FIG. 6 and FIG. 8, the traveling rails 140*a*, 140*b*, 140*c* of the track 120 are protruded in the more inner side of the traveling rails 40, 40 of the track 20. Therefore, the lateral width of the slits 60*a*, 60*b* are formed narrower than the non-diverging part in the diverging part 14*a* (14*b*).

As illustrated in FIG. 10, as the lateral width of the slits 60*a*, 60*b* is formed as described above, at least the traveling wheel 23 or the training wheel 53 can travel on the traveling rails 140*b*, 140*c* (or the traveling rails 140*a*, 140*c*) in crossing the wheel support part 32 over the slit 60*a* (or the slit 60*b*).

Here, the case that the vehicle 13 enters the diverging part 14*a* (14*b*) from the contra-bypass route 12*b* side will be described with reference to FIG. 10. First, the traveling wheel 23 and the training wheel 53 are traveled on the traveling rail 140*b* on the both right and left sides. Next, if the vehicle 13 chooses the bypass route 12*b* side, the training wheel 53 on the main track 12*a* side is run off. Further, if the vehicle 13 is traveled, the training wheel 53 is run on the traveling rail 140*c* and the traveling wheel 23 on the main track 12*a* side is run off. Finally, both the traveling wheel 23 and the training wheel 53 are arranged to travel on the traveling rail 140*c* even on the main track 12*a* side. In other words, at least the traveling wheel 23 or the training wheel 53 is surely traveled on the traveling rail on the both right and left sides while the vehicle 13 is traveling in the diverging part 14*a* (14*b*).

Moreover, as illustrated in FIG. 10, the lateral width of the traveling rails 40, 40 and the lateral width of the slits 60*a*, 60*b* in the track 20 is the width such that only the traveling wheels 23, 23 are traveled on the traveling rails 40, 40 and the training wheels 53, 53 are run off in the non-diverging part, and the traveling vehicle body 21 is arranged to be supported by only the outside traveling wheels 23, 23 . . .

Additionally, the above structure that the slit is formed such that at least the traveling wheel 23 or the training wheel 53 can travel on the traveling rails 140*a*, 140*b*, 140*c* in the diverging part 14*a* (14*b*) and such that only the traveling wheel 23 can travel on the traveling rail 40 can be applied to the floor vehicle as well as the vehicle 13.

Moreover, the slits 60*a*, 60*b* are formed between a pair of the traveling rails in order for the vehicle 13 to support articles on the lower side of the track 12 in the preferred embodiment of the present invention, however the guide groove can be formed between a pair of the traveling rails by turning the vehicle 13 and the track 12 upside down and supporting articles on the upper side of the track 12 as described above, for example.

Power feeder holders 30, 30 are disposed facing the pick up unit 9 in the lower face of the both sides of the track 20 that is the both sides position of the pick up unit 9.

A ferritic core 3 whose cross section is almost E-shape is fixed in the pick up unit 9 and a pick up coil 4 is wound around the central protruding part of the core 3. The respective power feeders 5, 5 retained by the power feeder holders 30, 30 is arranged to be located in the spaces that are composed of two concave parts formed between the protruding part of the both ends (the up and down in the center of FIG. 2 and FIG. 3) and the central protruding part in between them in the core 3. The magnetic field generated by applying the high frequency current to the power feeders 5, 5 is arranged to be received with the pick up coil 4, and the power is picked up from an induced current generated in the pick up coil 4 by utilizing the electromagnetic induction phenomenon. Thus, power is supplied from the power feeders 5, 5 to the pickup unit 9 in a non-contact manner, and the motors 16. 29 are driven or the power is supplied to the control equipment.

Moreover, the driving wheels 23, 44 and the training wheels 53, 54 of the vehicle 13 are provided on the both upside and downside in the preferred embodiment of the present invention, however only the traveling wheel and the training wheel on the ground side can be enough. In other words, only the traveling wheel 23, the training wheel 53 can be enough if the vehicle 13 is served as the overhead vehicle and only the traveling wheel 44, the training wheel 54 can be enough if used as the floor vehicle.

Moreover, the width of the traveling rail 140 of the track 120 in the diverging parts 14*a*, 14*b* is broader than the traveling rail 40 even if the vehicle 13 is used as the floor vehicle since the vehicle 13 and the track 12 is used for the overhead and floor vehicle in the preferred embodiment of the present invention, however the width can be the same as the traveling rail 40 so as to contact only the traveling wheel 23 with the traveling rail 140.

Moreover, the traveling rail 40 and traveling rail 140 can be cut from the track 20 and the track 120 unless the traveling wheel 23 and the training wheel 53 are provided.

As the vehicle is traveled on the traveling rail such that a part of the traveling wheel supporting the vehicle blocks the groove or the slit in the diverging part and the vehicle is driven to travel by pressing the top or bottom driving wheel energized to either one side to the traveling face formed along the track in the track guided vehicle system having the right and left traveling rails and the diverging part on the way that the vehicle is traveled on the track which becomes the groove or the slit between the traveling rails, the traveling face is continued in the diverging part and the driving wheel contacted with the traveling face can be prevented from running off.

Moreover, even if the traveling vehicle body is leaned upward and downward by running off the traveling wheel with the groove or the slit, the driving wheel can be surely contacted with the traveling face with the pressure means.

The track is shaped like a single long tube including the traveling rail and the traveling face, so that the number of parts and the manpower for installation can be reduced.

The vehicle has the diverging roller and the traveling direction of the vehicle is changed with use of the diverging part when the diverging roller is contacted with a plurality of the guide grooves formed along the track, so that the formation period of the system can be shortened, compared with the case that a diverging mechanism is provided on the track side.

Moreover, the layout of the system can be easily changed.

What is claimed is:

1. A track guided vehicle system having right and left traveling rails and a diverging part for changing the direction that a vehicle travels on a track having a groove or a slit between the traveling rails, wherein the vehicle travels on the traveling rails such that a part of a traveling wheel or a training wheel supporting the vehicle at least travels on the right and left traveling rails in the diverging part and the vehicle travels by pressing a driving wheel energized by a pressure means to always contact a traveling face formed along the track.

2. A track guided vehicle system as described in claim 1, wherein the track is shaped as a single long tube, said track including the right and left traveling rails and the traveling face.

3. A track guided vehicle system as described in claim 1, wherein the vehicle has a diverging roller as the diverging part and the traveling direction of the vehicle is changed by the diverging roller selectively contacting one of a plurality of guide grooves formed along the track.

4. A track guided vehicle as described in claim 2, wherein the vehicle has a diverging roller as the diverging part and the traveling direction of the vehicle is changed by the diverging roller selectively contacting one of a plurality of guide grooves formed along the track.

* * * * *